United States Patent [19]

Anthony

[11] 4,170,048

[45] Oct. 9, 1979

[54] TOILET INSTALLATION

[76] Inventor: Alain Anthony, Parc Offenbach, 33, rue Cartault, 92800 Puteaux, France

[21] Appl. No.: 760,397

[22] Filed: Jan. 18, 1977

[30] Foreign Application Priority Data

Jan. 20, 1976 [FR] France ..... 76 01406

[51] Int. Cl.[2] ..... E03D 3/10; E03D 5/02

[52] U.S. Cl. ..... 4/321; 4/361; 4/434; 73/304 R

[58] Field of Search ..... 4/10, 302, 115, 300, 4/314, 317, 323, 313, 321, 305, 434; 73/290, 304 R; 116/118 R; 137/386, 392, 393

[56] References Cited

U.S. PATENT DOCUMENTS

| | | | |
|---|---|---|---|
| 2,202,197 | 5/1940 | Ewertz | 73/304 R |
| 3,538,517 | 11/1970 | Cornish et al. | 4/10 |
| 3,566,415 | 3/1971 | Culp | 4/10 |
| 3,579,651 | 5/1971 | Russo | 4/115 |
| 3,698,019 | 10/1972 | Culp | 4/10 |
| 4,032,996 | 7/1977 | Sargent et al. | 4/10 |

FOREIGN PATENT DOCUMENTS

| | | | |
|---|---|---|---|
| 883741 | 7/1953 | Fed. Rep. of Germany | 137/392 |

*Primary Examiner*—William D. Martin, Jr.
*Attorney, Agent, or Firm*—Diller, Ramik & Wight

[57] ABSTRACT

A toilet installation is disclosed which is especially suited for pleasure boats. A discharge tank is disposed under a toilet fixture and connected with it through an inlet orifice. A flexible obturating member comprising a flexible flap member and a downwardly opening cup-shaped float member is fixed at one side of the inlet orifice so that the flexible obturating member hangs in the discharge tank when the latter is not pressurized. Compressed air from an air compressor is carried through a conduit for pressurizing the discharge tank and expelling the effluent from the discharge tank through a drain orifice, the outlet end of the conduit is aimed at the underside of the float member so that compressed air issuing from the conduit thrusts the obturating member against the inlet orifice thereby sealing off the discharge tank from the toilet fixture. A second tank for clean water is preferably provided having a distributor valve unit which selectively connects the hollow rim of the toilet fixture with the interior of the second tank for conveying flushing water thereto and brings the conduit into communication with compressed air from the air compressor. Liquid level detectors are provided in the discharge tank to detect the level of effluents. All nonreturn valves provided have similar open float members which are not in the effluent flow path.

16 Claims, 8 Drawing Figures

TOILET INSTALLATION

The present invention relates to a toilet fixture installation, particularly for use on a boat.

The invention relates more particularly to water closet and toilet fixture installations remote from their waste collecting units or disposal fields. At present the solid and liquid waste matter is conveyed from the toilet fixture to a remote collecting unit or disposal filed by means of suction pumps or force pumps or pneumatically by means of compressed air, the conveying circuit comprising, of course, check valves preventing the backing up of discharged waste matter.

One of the chief problems to solve for this type of toilet installation resides in the difficulty of obtaining fluid-tight sealing at the valves closing off the various pipes. In fact, good sealing by means of valves is made difficult, if not impossible, by the presence of solid waste, such as heavy paper, cloth, sticks, match sticks, cigarette butts, which is thrown or dropped into the toilet bowl; moreover, the pivots of such valves are always subject to corrosion and/or sticking. Finally, in the long run, the seats of the valves may become fouled and their floats, which are usually hollow spheres may take in water and thereafter have difficulty in floating properly.

The result is that the effluent backs up into the toilet bowl oozes through sliding seals, giving off nauseating odors.

This situation is particularly distressing on board ships and boats, particularly pleasure boats, where the toilet bowl is below the waterline.

In a device describes in U.S. Pat. No. 3,566,415 the waste matter is expelled from the toilet bowl by compressed air and the outlet of the closet is closed off by a semirigid valve member preshaped as a part-spherical cup and mounted at the end of the vertical sliding stem actuated by water under pressure. Although the sealing is better in this device than with rigid valve members, the part-spherical obturating member in this patent is still too rigid owing to its preformed construction to be able to mate perfectly with the fouled edge of the outlet of the toilet, and further, its sliding stem and its associated guide may be immersed in the discharged waste matter, with the consequent drawbacks and risks of corrosion, jamming and sticking, such that the device does not allow this problem to be satisfactorily overcome. Moreover, another problem is posed for small boats; the water closets or toilets on board such boats are generally located below the waterline. To prevent water outside the boat from flowing back up the waste discharge pipe, the waste discharge pipe is of inverted U-shape in elevation, with its bend above the waterline and an air trap therein which prevents the backing up of water into the discharge tank. Yet, If the waste matter is improperly discharged and the bend in the waste pipe is full of discharged waste matter, the ambient water seeps in, and this starts a siphon action which draws water into the discharge tank. This phenomenon is at first slow but accelerates later as the discharge tank fills and weighs down the boat which could even sink if there is no one on board to stop the siphon action. Such an accident is rather frequent and the sinking of about half of all boats sunk in port occurs in this manner.

The aim of the present invention is the provision of a toilet installation for discharging waste matter from the toilet fixture in total safety, without the chance of effluent backing up or disgusting odors being given off, owing to the perfect sealing of the valves, and also is the prevention of water from backing up into the toilet fixture which might even cause the boat to sink.

The present device according to the invention for discharging waste matter from a toilet fixture, particularly on board a boat, comprises a discharge tank which is positioned below the toilet fixture and provided with a drain hole and an inlet orifice which communicates with the toilet fixture, an obturating member adapted to closely mate with the edge of the inlet orifice to provide a fluid-tight seal and a source of compressed air for pressurizing the discharge tank through an air supply conduit so as to expel effluent including the waste matter through the drain orifice, the obturating member being flexible and fixed at one side to the inlet orifice so that it hangs inside the tank when the tank is not under pressurized and the compressed air supply conduit opens near and directs compressed air towards the obturating member so that it is driven back and urged against the edge of the inlet orifice under the pressure of a blast of compressed air issuing from the conduit.

According to a preferred embodiment of the invention, the installation comprises liquid level detecting means in the discharge tank and means for automatically controlling the operation of the air compressor means and the obturating member in response to the level of effluent in the tank.

According to another preferred embodiment the device comprises a second tank which communicates with a water supply conduit and a compressed air supply conduit connected to said air compressor means for driving out water from the second tank, the second tank including a distributor valve unit responsive to the water level in the second tank and communicating selectively through a line with the toilet fixture for delivering washing, out or flushing water and with the discharge tank for conveying compressed air thereto.

According to the invention the toilet installation for discharging waste matter therefore comprises no mechanical pumping means or any rigid valve members in the effluent flow path, the discharge of the waste matter being effected by increasing the pressure in the discharge tank which collects the same from the outer of the toilet fixture, good fluid-tightness produced by the flexibility of the obturating member permitting alone such an increase in pressure in the discharge tank without the chance of backing up into the bowl. The valve fluid-tightness problem is thus resolved in the present installation by disposing the valves outside the flow path of the effluent, the only valve member which must be located in the flow path, i.e. the obturating member at the outlet of the toilet fixture being formed as a flexible flap member fixed at the edge of the inlet orifice of the discharge tank, which eliminates the use of any rigid stem which might corrode or jam the obturating member.

Whatever the solid waste matter or debris entrained by the flushing water, the flexible obturating member properly seals off the discharge tank and prevents the backing up of effluent and offensive odors into the toilet fixture. Further, since the waste matter is expelled under pressure, the present toilet installation may be located remote from a central discharge collector for a building and connected thereto through a long, small-diameter pipe which may have bends for changing levels. The installation is also particularly useful for pleasure boats where the bowl of the toilet is below the waterline. By means of the liquid level detecting means of the present toilet installation, the sinking of boats due to the backing up of ambient water can be prevented.

The invention will now be described in greater detail with reference to preferred embodiments given by way of example and illustrated in the accompanying drawings, in which.

Figure 1:
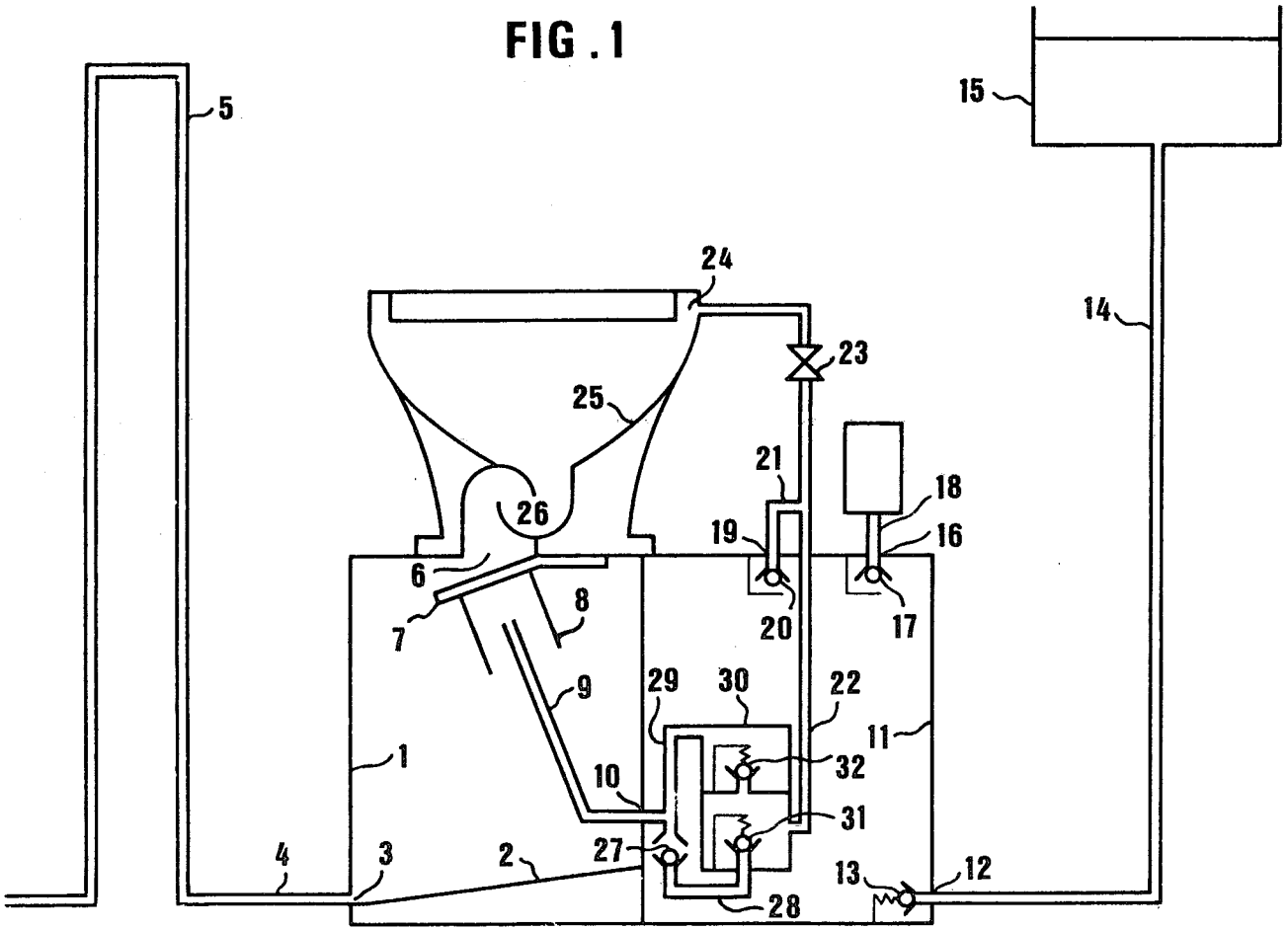
FIG. 1 is a diagrammatic section of the entire toilet installation for discharging waste matter, according to a first embodiment.

The preferred embodiment illustrated in FIG. 1 comprises a so-called discharge tank 1 having an inlet orifice 6 communicating with the toilet fixture having a bowl 25 through its siphon 26. The inlet orifice may be closed off by a flexible flap member or obturating member 7, fixed to the edge of the inlet orifice 6 and provided with a downwardly opening cup-shaped float 8; the obturating member is made, for example, of a flexible plastics material or an elastic material such as rubber. The bottom of the tank 1 is provided with an inclined surface 2 the lower end of which is located proximate to the drain orifice 3 running into a conduit 4 of inverted U-shape in elevation for example, the high point or bend 5 in the conduit being disposed substantially above the level of the bowl. This first tank 1 communicates with a second tank 11, called an accumulation tank, through a tube or conduit 9 through an opening, the outled end of the tube 9 being disposed inside the cup-shaped float 8. The second tank 11, adjacent to the first, is supplied with flushing or washing out water from a flush tank or cistern 15 through a conduit 14 entering the second tank through an opening 12, the conduit 14 having a check valve 13. The second tank 11 is provided in its upper part with compressed air through a conduit 18 via opening 16, the conduit 18 being provided with a check valve 17 operative in response to the water level for allowing the compressed air to flow into and preventing the water to flow out of said second tank when the level of the float is reached. The source of compressed air is an air compressor in this embodiment. An exhaust valve 20 allows the air to espace from the second tank 11 through tube 21 by way of opening 19. A distributor valve unit 30 is accommodated inside the second tank 11 and has an inlet orifice through which the tube 28 passes, the tube 28 being closed off by a check valve 27 which opens the tube when the level of water is above the float valve member 27 and closes it when it is below. The tube 28 opens into a first chamber via level responsive non-return valve 31, biased closed at a pressure $P_1$ greater than the manometric pressure of the height of water H corresponding to the water level in the reserve tank or cistern 15, but less than the pressure P of the compressed air ($H<P_1<P$). The first chamber communicates with the hollow rim 24 of the toilet bowl through the line 22 which has a stop cock 23. The first chamber communicates with the second chamber via level responsive non-return valve 32 adjusted to a pressure $P_2$ greater than $P_1$ but less than $P(P_1<P_2<P)$, the second chamber being connected directly to a tube 29 which has an inlet in the tank 11 through an opening located vertically above the float valve member 27 which closes the inlet at high water levels and opens it at low water levels.

The tube or conduit 9 which opens inside the cup-shaped float 8 passes through an opening in the common wall separating tanks 1 and 11 and connects up with the tube 29.

The toilet installation operates as follows. After use, the accumulation tank 11 fills up with flushing or washing out water coming from the reserve tank 15; as the water level rises in the accumulation tank the air trapped inside the tank 11 is exhausted simultaneously through the tubes 9 and 21 until the water level reaches the float valve member 27 which then closes off the tube 29, opening the tube 28. When the level reaches the level responsive valve members 17 and 20, the tubes 18 and 21 are closed off and the tank 11 is completely sealed off since the tube 28 is closed off by the valve member 31 biased closed at a sealing pressure $P_1$ greater than the manometric pressure H of the water in the reserve tank 15. The compressor is then started up and compressed air is carried to the tank 11 through tube 18 via valve member 17; the pressure rises in the second tank 11 up to the preset closure pressure $P_1$ of valve member 31 which eventually opens and the water is displaced under pressure to the hollow washout rim 24 of the toilet bowl 25 over tube 28 and line 22 via stop cock 23. It will be noted that the rise in pressure is made possible by the fact that the float valve member 20 has previously been urged against its seat by the water and is maintained in its closed position by the compressed air.

Upon flushing the toilet fixture waste matter carried through the siphon 26 falls onto the inclined surface 2 and collects at the drain orifice 3 of the discharge tank 1 while the level of effluent rises, raising the cup-shaped float 8 and the associated obturating member 7 towards the inlet orifice 6 of the discharge tank. In the accumulation tank 11 the level of water drops until it falls below the high position of the float valve member 27 which enables the flow of compressed air through the tubes 29 and 9. The flow of compressed air issuing from the outlet end of tube 9, disposed inside the cup-shaped float 8 thrusts the flexible obturating member 7 against the inlet orifice 6, hermetically sealingly mating with the contour thereof.

Then the pressure rises in the discharge tank 1, which drives the effluent and solid wastes through the drain orifice 3 and the small diameter tube 4 to the common collecting unit. In case the waste matter discharged from the toilet fixture partially fills the discharge tank 1 and the water for flushing the bowl could cause the discharge tank 1 to overflow, the stop cock 23 is closed and the air compressor is put into operation. The pressure rises in the second accumulation tank 11, and when it reaches a pressure $P_1$ this causes the preset valve member 31 to open; water fills the first chamber but, since it is trapped, not being able to escape through the line 22 as before, the pressure continues to rise reaching pressure $P_2$ which is the preset biasing pressure acting on valve member 32 which then opens.

The water under pressure then flows into the second chamber of the distribution valve unit, through tubes 29 and 9 and into the discharge tank 1 in which the water level rises to the cup-shaped float 8, urging the flexible obturating member 7 against the inlet orifice 6, thereby sealing it off. The air compressor continues to blow the water out of the accumulation tank 11 which is then blown into the first tank 1 and drained therefrom via the drain orifice 3. When the water level in the accumulation tank 11 drops below the level of the preset valve member 27, the compressed air is delivered to the discharge tank 1 and keeps the flexible obturating member 7 pressed against the orifice 6 while the effluent is expelled through the orifice 3 and tube 4.

It will be realized that in the above described embodiment of the installation the rigid valve members are located in the clean water in the accumulation tank 11 and only the flexible obturating member 7 is located in the flow path of waste matter, which obturating member, due to its inherent pliability is able to intimately conform to the contour of the inlet orifice 6, hermetically sealing off the same whatever solid waste matter is flushed out of the toilet bowl.

Different modifications can of course be envisaged.

Thus, for instance, the flexible obturating member 7 for the inlet orifice 6 may be replaced by an inflatable obturating member of ball shape fixed at a position on the edge of the inlet orifice 6, the wall of the inlet orifice having a frustoconical portion flared toward the interior of the tank 1. When such an inflatable obturating member is at rest, it is deflated and hangs next to the inlet orifice 6, and when the compressed air is driven from the accumulation tank 11 into the discharge tank 1, it first blows up the deflated obturating member which, blown up, seals off the frustoconical wall of the orifice 6, the fluid-tightness is then enhanced as the pressure rises in the discharge tank 1, forcing the inflated ball into the frustoconical wall of the orifice.

Similarly the installation may be simplified, provision being made for only one of the discharge and accumulation tanks, i.e. the discharge tank, the conduit 9 being connected directly to the source of compressed air. In such a simplified arrangement the reserve tank or cistern 15 communicates directly with the bowl 25 through the conduit 14 which then opens in the hollow washout rim 24 of the bowl. A water meter mounted on the conduit 14 permits the measuring of the amount of water conveyed to the bowl for flushing out waste matter and the simultaneous control of both the valve to cut off the flow of water and the starting of an air compressor connected to the tube 9.

The measuring of the flushing water carried to the toilet fixture and the starting of the air compressor may both be controlled by a float gauge disposed in the discharge tank 1, the float being, for example, the cup-shaped float integral with the flexible obturating member 7. The operation is as follows. After use, water in the accumulation tank 15 is delivered to the bowl 25 and is discharged into the discharge tank 1 until a predetermined volume of effluent fills the discharge tank; the meter or gauge stops the flow of flushing water and starts the air compressor. The compressed air thrusts the obturating member against the inlet orifice 6 of the discharge tank 1 and liquid and solid waste matter is discharged as described hereinabove.

A baffle or deflector may also be positioned in the cup-shaped float 8 so as to create a swirling of the air and effluent in order to unstick and dislodge any solid wastes from the wall of the discharge tank 1 to facilitate their discharge.

Figure 2:
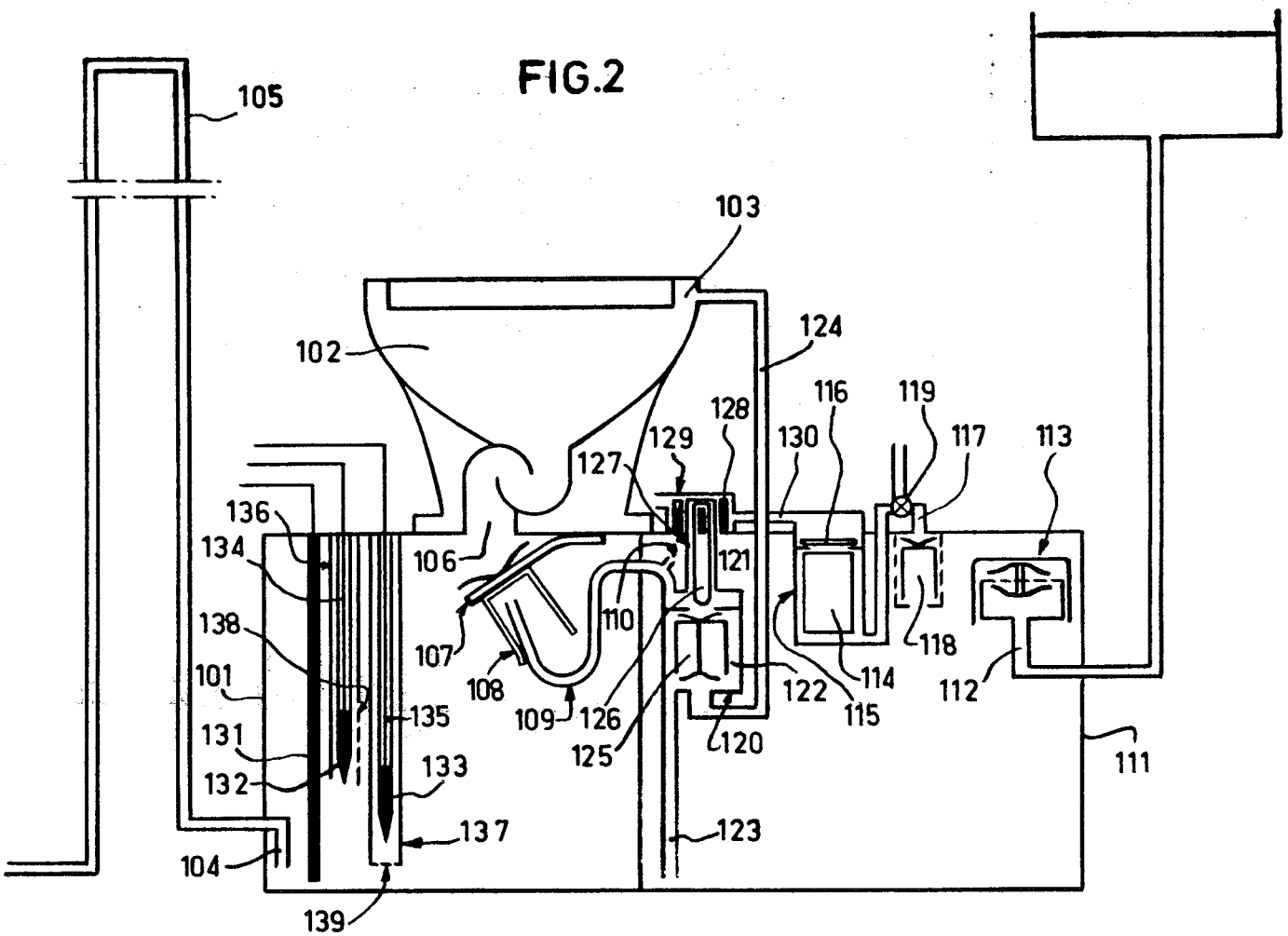
FIG. 2 is a similar view illustrating a modified form of the installation according to a second embodiment.
Figure 3:
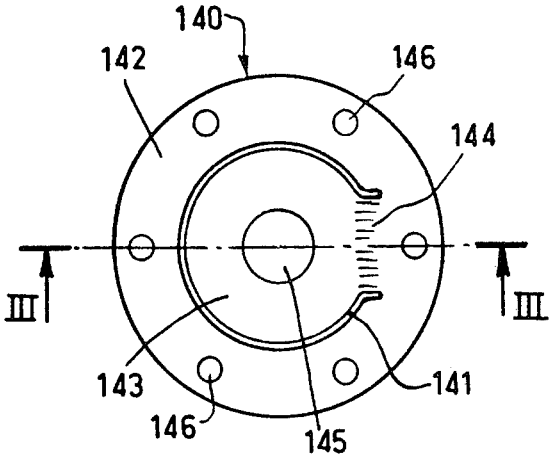
FIG. 3 shows a flexible obturating member for the installation.
Figure 5:
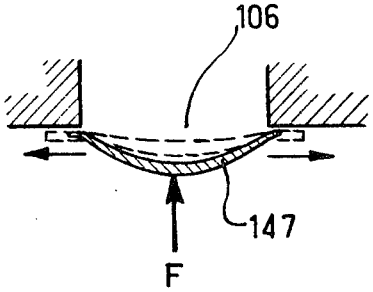
FIG. 5 illustrates the deformation of the valve member on the obturating member in the closed position.
Figure 4:
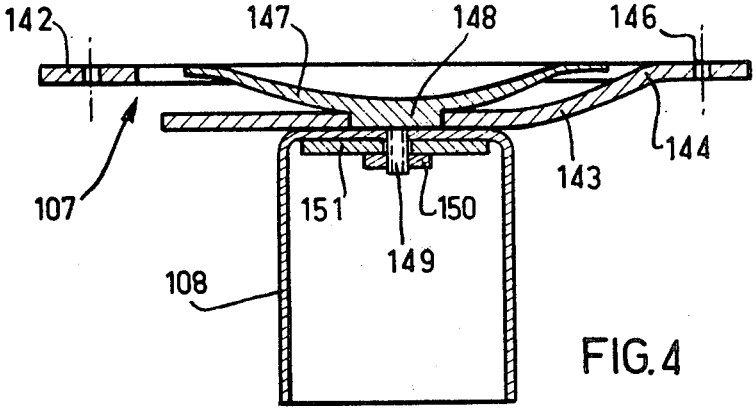
FIG. 4 shows the flexible obturating member in cross section taken on the line III—III in FIG. 3.

In a second preferred embodiment, illustrated in FIG. 2, the toilet installation comprises, under the toilet fixture including a bowl 102, a discharge tank 101 having an inlet orifice 106 communicating with the toilet bowl through a siphon, the inlet orifice 106 being sealed off by a flexible obturating member 107 fixed to the edge of the inlet orifice 106 and provided with a flexible downwardly opening cup-shaped float 108 which is made as well as the obturating member 107, for example, of flexible or pliable plastics material or of an elastic material such as rubber. The bottom of the discharge tank 101 is provided with a channel which amasses the waste matter at the lower part of the tank 101, proximate to a drain elbow 104 connected to a drain pipe 105 which may be of inverted U-shape in elevation, with its bend at the highest point located above the water line of the boat. Inside the discharge tank 101 are three vertical level detectors 131,132 and 133 electrically connected for detecting the effluent level in the first tank. The first level detector 131 is a grounded or earth detector and its lower end is in the vicinity of the bottom of the discharge tank, the second level detector 132 is called a "first stop" detector with its lower end higher than the lower end of the third level detector or level maintaining detector 133. Each of the three level detectors comprises a graphite stick or electrode with a pointed lower end. The level detectors 132 and 133 are fixed to the ends of plastic rods 134 and 135 and housed inside vertical protective tubes 136 and 137 having their lower ends open. The tube 136 housing the first stop level detector 132 has a plurality of vent holes 138 at its lower end to allow air to escape when the liquid level rises in the tube. On the other hand, the tube 137 housing the level maintaining detector 133 has no vent holes and extends below the lower end of the associated graphite stick, its opening being substantially at the same level as the orifice of the drain elbow 104 and having a screen 139 to prevent solid matter from rising in the tube.

The discharge tank 101 communicates with a second tank 111 called "accumulation tank" through an S-shaped tube 109 which terminates in the cup-shaped float 108. The other end of the tube 109 is connected to a distributor valve unit 120 which is accommodated in the accumulation tank 111 and communicates with the same through a diving tube 123 and with the hollow rim 103 of the toilet bowl 102 through a line 124. The flow of water is divided between discharge tank 101 and the toilet bowl rim 103 by means of a float valve member 125 with seals, vertically displaceable in the body 122 of the distributor valve unit 120. An electromagnetically actuatable plunger 126 is provided above the float valve member 125 for unsticking it from its raised position after the toilet fixture has been flushed out.

A sealed vessel 115 containing a small air compressor 114, for example a bladed air compressor, is positioned inside the accumulation tank 111 and a transistorized printed circuit 116 is electrically connected to the level detectors 131, 132 and 133 for controlling the air compressor. The sealed vessel 115 communicates to the surroundings through a tube 130 which carries ambient air to the air compressor 114 via the printed circuit 116 for cooling the latter, the compressed air being delivered into the accumulation tank 111 through a tube 117 having an elbow above the tank, the outlet end of the tube 117 being closed off by a level response valve device 118 for avoiding the potential backing up of water into the elbow. A three-way valve 119 is provided at the elbow 117, which valve can be connected to an inflating device, such as a hand pump or foot operated inflater, for use in case of a breakdown of the air compressor 114. It shall be noted that the air compressor 114 is acoustically isolated owing to its being housed inside the vessel 115 in the accumulation tank 111.

Water is supplied to the accumulation tank 111 through a supply conduit 112 which communicates with a reserve tank or with the surroundings and delivers water to the accumulation tank through a vertical rising tube portion, the outlet end of which is provided with a double-action valve device 113 having controlled one-way micro-leaking or bleeding means.

Finally, there is provided an electrical switch (not shown) on the seat of the toilet which switch is connected to the air compressor for automatic actuation when the lid is pivoted to its closed position.

These various valve arrangements are illustrated in greater detail in FIGS. 3–7.

The flexible obturating member 107 closing off the inlet orifice 106 of the discharge tank 101 comprises a flexible flap member 140 (FIG. 3) with a part-circular slit 141 so as to partially separate the central portion 143 from an annular peripheral portion 142 while nevertheless being connected by a portion 144 serving as a hinge between the central and peripheral portions 143 and 142. An aperture 145 is disposed in the central portion 143, and holes 146 for fasteners are spaced around the peripheral portion 142.

A dish-shaped flexible valve member 147 is mounted on one face of the central portion 143 of the flexible flap member (FIG. 4), which valve member has a thickened base 148 serving to locate it in the aperture 145 in the flap member. A cup-shaped float 108 is secured to the opposite side of the flap member, the skirt of the cup-shaped float being elastically deformable and the bottom thereof being traversed by a threaded pin 149 fixed to the base 148 of the valve member. The threaded pin joins the assembly together, including the valve member, the central portion 143 of the membrane and the float 108 in cooperation with a nut 150 and a rigid washer 151 which is interposed between nut 150 and the bottom of the float 108 and serves to rigidify the center of the obturating member 107.

The obturating member 107 is fixed to the upper wall of the discharge tank 101 by means of screws passing through holes 146 so that the peripheral portion 142 surrounds the inlet orifice 106, the central portion 143 of the flap member 140 bending about the hinge portion 144 connecting with the peripheral portion 142 and hanging inside the discharge tank 101.

It will be noted that the flexibility of the skirt of the cup-shaped float 108 allows its deformation when the float bears against the tube 109 (FIG. 2) and thereby permits a greater opening of the obturating member 107. The flexible valve member 147 has a thin elastically deformable edge making it self-cleaning by a wiping action.

In fact, since the valve member, upon its closure, is subjected to a force F (FIG. 5) its edge bears against the edge of the inlet orifice to be sealed off, it then deforms radially, rubbing against its seat, thereby pushing outwardly any possible clogging substances which might foul the sealing surface of the sealing member.

Figure 6:
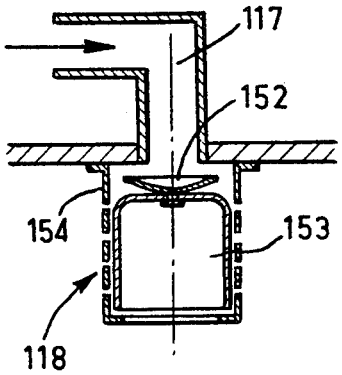
FIG. 6 shows, on an enlarged scale, a level responsive valve arrangement for the air supply conduit of the second embodiment.

The level responsive valve device 118 which serves to seal off the compressed air line 117 comprises, as shown in FIG. 6, a downwardly opening cup-shaped float 153 having a valve member 152 at its upper end, which cup-shaped float is vertically displaceable in a cylindrical guiding cage 154 fixed to the upper wall of the accumulation tank 111, the cage comprising a perforate lateral wall allowing the flow of air and an open lower end enabling water to rise inside the float.

Figure 7:
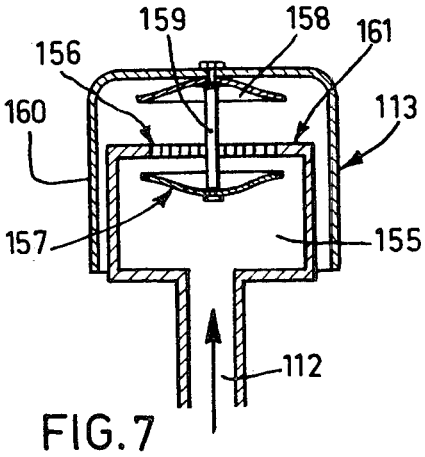
FIG. 7 is a longitudinal sectional view, on an enlarged scale, of the double-action valve arrangement for the water supply conduit in the second embodiment.

The double-action valve device 113 which regulates the inflow of water into the accumulation tank 111 comprises, as shown in FIG. 7, a downwardly opening cup-shaped float 160 having a central guide stem 159 on which are mounted, facing each other, an upwardly oriented dish-shaped lower valve member 157 and a downwardly oriented dish-shaped upper valve member 158. The valve members 157 and 158 are adapted to bear selectively against the upper wall of an admission chamber 155 disposed at the outlet of the vertical rising portion of the supply conduit 112, for sealing off ports 156 in the upper wall.

At least one groove 161 connected to at least one of the ports 156 at the periphery is provided on the upper side of the perforate wall, the groove extends the or each hole beyond the zone covered by the upper valve member 158 so that, even when the upper valve member 158 is closed there, is still a small passageway ensuring communication between the interior of the accumulation tank 111 and the water admission chamber 155; on the other hand, as the groove 161 is only formed in the upper side of the perforate wall, the valve is entirely closed and fluid-tightness is complete in the opposite direction when the lower valve member 157 is urged against the underside of the perforate wall of the admission chamber 155. The groove 161 thus provides a controlled countercurrent leaking or bleeding of the supply water.

Figure 8:
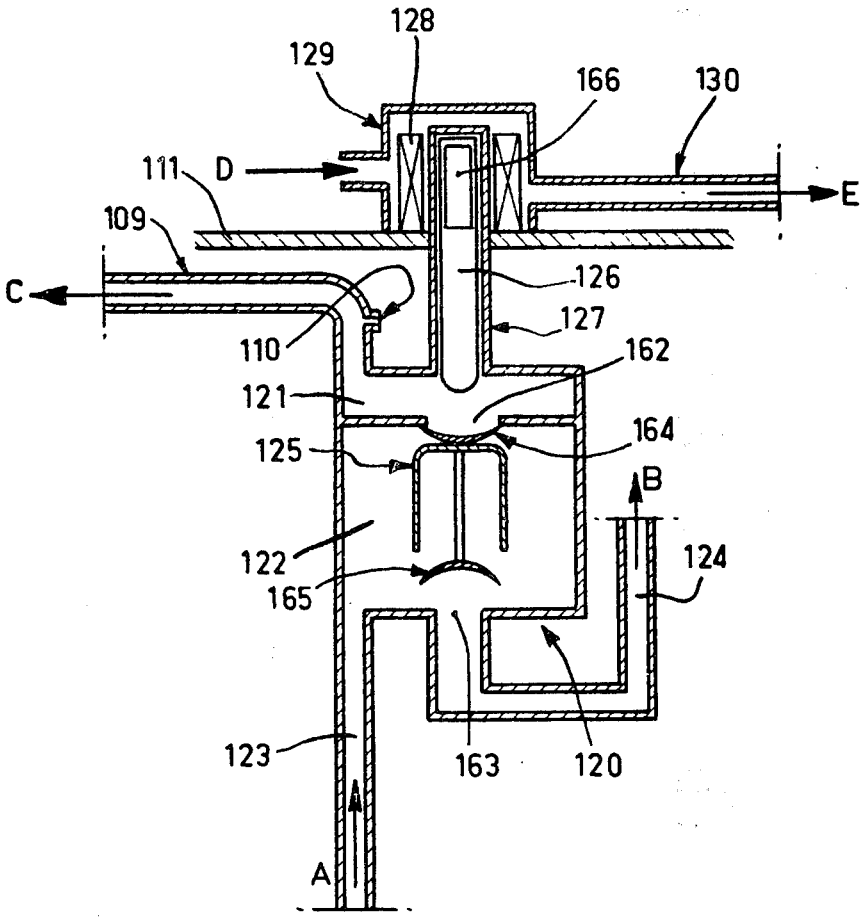
FIG. 8 is a longitudinal sectional view, on an enlarged scale of the distributor valve unit for distributing compressed air and washing out water in the second embodiment.

As illustrated in FIG. 8, the distributor valve unit 120 comprises a hollow body 122 in communication at its upper end through an orifice 162 with an upper chamber 121 and at its lower end with the accumulated tank 111 through the diving tube 123 which opens near the bottom of the accumulation tank and with the rim 103 of the bowl through an outlet opening 163 and line 124. A downwardly opening cup-shaped float 125 provided with upper and lower valve members 164 and 165, interconnected by a stem, are displaceable vertically inside the hollow body 122 so as to seal off selectively orifices 162 and 163 disposed substantially above each other, the guiding of the float for vertical movement being effected by any suitable means, such as, for example, a perforated guide tube (not shown) accommodating the float. The upper chamber 121 is in communication with the discharge tank 101 by means of tube 109, said tube having a decompression vent hole 110 of small predetermined size opening in the accumulation tank 111. A fluid-tight tubular housing 127 forms an upward continuation of the upper chamber 121, passing through and beyond the upper wall of the accumulation tank 111. The tubular housing 127 which is located in line with the superposed orifices 162 and 163 serves to house a plunger 126 mounted for vertical sliding movement therein, the plunger having a permanent magnet 166 at its upper end. An induction coil 128 is disposed about the portion of the tubular housing 127 which is situated above the upper wall of the tank 111, surrounding the permanent magnet 166 when the plunger 126 is in its raised position. A protective case 129 encloses the coil 128 and communicates with both the vessel 115 for the air compressor through the tube 130 and the surroundings through an air intake provided on the side of the coil 128 opposite the open end of the tube 130 so that fresh air drawn into the air compressor cools both the printed circuit 116 and the coil 128.

The just described embodiment operates as follows. As the installation is ready to be used, the level of effluent in the discharge tank 101 is minimal and just touches the orifice of the drain elbow 104 and the screen 139 at the lower end of tube 137, the flexible obturating member 107 hangs down, opening the inlet orifice, and the accumulation tank 111 is filled with clean water. The water level in the accumulation tank 111 buoys the float 125 of the distributor valve unit upwards as well as the float 153 of the level responsive valve 118 and the float 160 of the double-action valve device 113 such that the distributor valve unit affords communication between the tank 111 and the hollow rim 103 of the bowl, the water supply being cut off.

When the user lowers the lid of the toilet seat, the associated switch is actuated and the electrical circuit turned on, which starts the air compressor 114, blowing air into the accumulation tank 111; the float 118 is thrust downwards by the compressed air and so is the float 160 whose upper valve member 158 seals off the ports 156 in the perforate wall of the admission chamber 155, a controlled compressed air leak develops through the passageway or groove 161 from the tank 111 towards the inside of the admission chamber 155 in order to clean out the supply conduit 112 and flush out any solid, fouling matter which could possibly have reached the same.

As the pressure rises in the tank 111, water is delivered to the distributor valve unit 120 through the diving tube 123 and is carried to the hollow rim 103 of the toilet bowl via orifice 163 and line 124. The clean, flushing water washes out the toilet and falls into the discharge tank 101 whose liquid level mounts and reaches the first stop level detector 132 which sends electric pulses simultaneously to the transistorized time-delay printed circuit 116 and the coil 128 in part defining control means responsive to the rise of effluent under pressure within the tube 137 to maintain the discharge tank 101 under pressure until the effluent has been discharged therefrom through the drain elbow 104, as will be described more fully hereinafter. The circuit 116 turns off the air compressor for a preset period (about 8 seconds) required for the decompression of the accumulation tank 111, the compressed air being exhausted through the vent hole 110 and the tube 109 into the discharge tank 101 which is open. At this stage of operation, the level of clean water has dropped below the inlet opening of the diving tube 125, which draws the water from near the bottom of the tank 111 whereby the float 125 of the distributor valve unit is no longer buoyed by either the water or the compressed air, the latter having been exhausted through the vent hole 110. Also, a small impact of the plunger 126, thrust downwards by the electromagnetic force of the coil 128 against the permanent magnet 166, is sufficient to unstick the valve member 164 from its seat, causing the float 125 to fall by gravity, the lower valve member 165 closing the orifice 163. The air compressor 114 is started up by the time-delay circuit 116 again, the pressure in the tank 111 increases again despite the controlled leak through the small air vent 110 whose flow rate is small compared to that of the air compressor. The water remaining in the accumulation tank 111 above the level of the opening of the siphon tube 123 is surged by the pressure of the compressed air into the body 122 of the distributor valve unit then through the upper orifice 162 which is open, and sprayed from the tube 109 into the cup-shaped float 108, the force of the spray leaving the tube 109 lifting the obturating member 107 and thrusting the valve member 147 against its seat, thereby closing the orifice 106; as soon as the remaining water has been expelled, a blast of compressed air enters the discharge tank 101, which keeps the obturating member 107 closed and causes the pressure to mount in the discharge tank.

It will be noted that, owing to the fact that protective tube 137 of the level maintaining detector 133 extends lower than the detector itself and has no air vents, air trapped in the tube 137 precludes the level of effluent from mounting as long as the tank 101 is not under pressure, hence the lower end of the first stop detector 132 alone is in contact with the effluent before the rise in pressure in the tank 101. But when the pressure rises, the effluent is expelled through the drain elbow 104, its level falls below the lower end of the first stop detector level tube 132 while at the same time the level in this tube 137 rises above the lower end of the level maintaining detector 133 which stays in contact with the earth or grounded detector 131 and keeps the circuit closed, thereby keeping the air compressor in operation. When the effluent including solid waste matter has been completely drained and the level in the tank has fallen to the level of the screen 139, closing off the bottom of the tube 137, the effluent is no longer in contact with the lower end of the level maintaining detector 133 and the air compressor stops automatically. The pressure then falls in the both tanks 101 and 111, the obturating member 107 is released and falls back, freeing the orifice 106; the supply water can once again buoy up the upper valve member 158 and enter the accumulation tank 111 through ports 156. The level of clean water rises and lifts the float 125 whose upper valve member 164 seals off the orifice communicating between the distributor valve unit and the tank 101, while the communication between the hollow rim of the toilet is reestablished; then the float 160 of the double-action valve device 113 is, in turn, lifted thereby shutting off the supply of water. The device is once again ready to operate. In case siphon action is re-established in the drain tube 105, gradually filling the discharge tank 101, as soon as the liquid level reaches the tip of the first stop detector 132, the operating cycle of the installation picks up with the time delay phase of the air compressor 114 and energization of the coil 128 and there is no flushing of the toilet then, because this could cause the overflow of the toilet bowl, as the flushing water would be adding to the water already drawn in.

The result is the same when several successive users forget to lower the lid of the toilet seat and therefore do not trigger the discharge cycle; either if no user has lowered the lid, the discharge cycle is triggered automatically, without washing out the bowl, when the liquid level attains the first stop detector 132, or if the last of successive users lowers the lid when the level is already near the tip of the first stop detector 132, the washing out or flushing out is triggered but interrupted immediately, as soon as liquid level reaches the first stop detector 132 which detector stops the air compressor and energizes the coil 128, the cycle then picking up after the washing out step.

In no case can the toilet bowl overflow and therefore the boat sink.

Preferably all the valve members of the installation are dish-shaped with elastically deformable peripheral edges, like the valve member of the obturating member 107 so as to be self-cleaning, too. It will be noted that none of the floats is fluid-tight but on the contrary they all open downwardly so as to empty automatically when the water level falls, which is not so with so-called fluid-tight float when they take in water. Moreover, the fact of placing the graphite level detectors 132 and 133 at the ends of rods 134 and 135 of plastics material and housing them inside protective tubes, fluid-tight at the level of said rods provides dry surfaces in the tubes and on the rods and therefore good electrical insulation between each level detector and its protective tube.

The invention is, of course, not limited to the preferred embodiments of the invention, described above, but covers all modifications, and equivalents within scope the appended claims.

What I claim is:

1. In a toilet installation comprising a toilet fixture, a discharge tank disposed beneath said toilet fixture and having a drain orifice and an inlet orifice with said inlet orifice being in fluid communication with said fixture, an obturating member for sealingly mating with an edge defining said inlet orifice to seal off said inlet orifice, a source of compressed air, conduit means connecting said compressed air source to said discharge tank for pressurizing said discharge tank and expelling effluent including waste matter through said drain orifice, a plurality of electrical level detecting means disposed in said discharge tank, at least one of said electrical level detecting means being a level detector housed within a vertical fluid-tight protective tube having an open lower end, and automatic control means responsive to the rise of effluent under pressure upwardly in said one protective tube and the detector therein for maintaining said discharge tank under pressure until effluent has dropped below the detector in said one protective tube and effluent has been expelled from said discharge tank through said drain orifice.

2. A toilet installation according to claim 1 wherein said level detector comprises a graphite electrode liquid level detector.

3. A toilet installation according to claim 2 wherein said graphite electrode has a pointed lower end.

4. A toilet installation according to claim 1 wherein said control means include time delay circuit means for controlling the connecting of said source of compressed air to said discharge tank.

5. A toilet installation according to claim 1 wherein said one and second and third electrical vertical level detectors are mounted inside said discharge tank for detecting the effluent level in the tank; said second level detector being of a grounded type and having a lower end in the vicinity of the bottom of the discharge tank, said third level detector having a lower end disposed higher than the lower end of the first level detector, and said one level detector having a lower end disposed at a level intermediate the levels of the lower ends of the second and third level detectors, said second level detector being housed inside a vertical protective tube having an open lower end, the tube housing the third detector having vent holes to allow air to escape when the liquid level rises in said tube, and the tube housing said one detector being free of vent holes and extending below the lower end of its associated detector.

6. A toilet installation according to claim 5 wherein each level detector is in the form of a graphite electrode liquid level detector.

7. A toilet installation according to claim 6 wherein said graphite electrodes which sense the level of effluent have pointed lower ends.

8. A toilet installation according to claim 2 wherein said level detector is fixed to a lower end of a plastic rod.

9. A toilet installation according to claim 1 wherein there is a tube having a terminal end directed towards said obturating member for delivering a pressurized fluid under the influence of said compressed air against said obturating member.

10. A toilet installation according to claim 9 wherein said pressurized fluid is said compressed air.

11. A toilet installation as defined in claim 1 wherein said protective tube extends below the lower end of the detector located therein in order to maintain said detector in contact with the effluent inside said protective tube when said discharge tank is pressurized for expelling the effluent.

12. A toilet installation as defined in claim 1 wherein said detecting means includes a second level detector housed within a second vertical fluid-tight protective tube having an open lower end, said one protective tube having its open lower end disposed lower in said discharge tank than the open lower end of said second protective tube, said one protective tube being imperforate, and said second protective tube being perforate above its open lower end.

13. A toilet installation as defined in claim 1 wherein said protective tube is constructed from electrical insulating material.

14. A toilet installation as defined in claim 1 including a screen at said one protective tube open lower end.

15. A toilet installation as defined in claim 1 wherein said detecting means includes a second level detector housed within a second vertical fluid-tight protective tube having an open lower end, said one protective tube having its open lower end disposed lower in said discharge tank than the open lower end of said second protective tube said one protective tube being imperforate, and said detector in said one protective tube being spaced axially away from the open lower end thereof.

16. A toilet installation as defined in claim 15 wherein said second protective tube is perforate above its open lower end.

* * * * *